United States Patent [19]

Ricard

[11] Patent Number: 4,889,192

[45] Date of Patent: Dec. 26, 1989

[54] TRACTOR-CONTROLLED HAMMER ASSEMBLY

[76] Inventor: Sylvio Ricard, 1137 Dufault Street, Duvernay, Canada, H7E 4S7

[21] Appl. No.: 270,515

[22] Filed: Nov. 8, 1988

[51] Int. Cl.[4] ..... F21B 7/02

[52] U.S. Cl. ..... 173/22; 173/50; 173/46; 173/24

[58] Field of Search ..... 173/22, 42, 43, 44, 173/18, 50, 51, 27, 46, 24

[56] References Cited

U.S. PATENT DOCUMENTS

| | | | |
|---|---|---|---|
| 494,909 | 4/1893 | Wallis . | |
| 1,945,322 | 1/1934 | Lafayette, Jr. | 173/51 |
| 2,228,445 | 10/1938 | DeVelbiss . | |
| 3,231,027 | 1/1966 | Viau . | |
| 3,584,816 | 6/1971 | Salkeld . | |
| 3,635,133 | 1/1972 | Stougnard . | |
| 3,757,875 | 9/1973 | Gunning . | |
| 4,087,010 | 5/1978 | Stormon | 173/18 X |
| 4,087,010 | 5/1978 | Stormon . | |
| 4,602,821 | 7/1986 | Schneff . | |

*Primary Examiner*—Douglas D. Watts
*Assistant Examiner*—Willmon Fridie, Jr.

[57] ABSTRACT

An apparatus for supporting conventional hand-held pneumatic breakers in such a way as to break a concrete slab down to the desired precise depth. The slab can be a building floor, bridge deck, or other slab required to be broken to a predetermined depth. The apparatus comprises a mounting frame adapted to replace the bucket of a mini-loader such that the mounting frame can be positioned at an adjusted level and orientation by the hydraulically operated arms and rams of the mini-loader. The mounting frame has an upper flange from which depend U-shaped guiding brackets between which are guided the transverse handlebar of each breaker. A guide for each drill bit of the breakers is fixed to the mounting frame. The breakers are free to move between a top and a lower limit position relative to the mounting frame. In the lower position the handle bars are supported by the bight of the U-shaped brackets. During the concrete slab breaking work, the drill bit abuts on the slab solely under the bias of the hammer weight; this results in precise drilling.

15 Claims, 3 Drawing Sheets

TRACTOR-CONTROLLED HAMMER ASSEMBLY

FIELD OF THE INVENTION

This invention relates to pneumatic hammers, and more particularly to those of the manually-operated type.

BACKGROUND OF THE INVENTION

Pneumatic hammers or breakers are used for breaking road pavement, such as concrete, asphalt, and the like ground materials. Such hammers generally consist of a tubular member having a bottom drill bit. Each hammer may be operated by a single man, either directly with both hands controlling the top transverse handle bar thereof, or indirectly via a tractor monitoring the hammer via a boom and hammer mount. These devices being potentially dangerous (for the arms, legs and feet of the worker) and generating heavy vibrations and high level of sound, they are less used directly by a man because of health considerations and also because they are time consuming. As for known machine operated hammers, the machine mounts are all fixedly mounted to the hammer bodies so that the machine boom will "push" the hammer to the ground; such pushing has a tendency of rendering the hammer a crude tool, i.e. that one cannot do precision work therewith and thus can damage a pavement layer not intended to be broken.

OBJECTS OF THE INVENTION

The gist of the invention is to provide a hammer apparatus combining the safety features (for the workers) of conventional machine-mounted hammer operation with the precision of work of manual hammer operation.

A corollary object of the invention is to provide such an apparatus which may operate a number of hammers concurrently.

SUMMARY OF THE INVENTION

In accordance with the teachings of the invention there is disclosed a hammer apparatus for breaking concrete slabs or the like hard ground surface, comprising a rigid frame, vertically adjustable holding means to hold said frame at an adjusted level above ground, at least one pneumatic hammer comprising an upper body, a lower reciprocating drill head, and a drill bit releasably fixed to said drill head, support means adapted to hangingly support said upper body to said mounting frame, at a lower limit position of said hammer, and channel means carried by said frame to guide vertical displacement of said upper body between said support means and a top limit position; wherein during the concrete slab breaking work with said drill bit abutting on the ground, said holding means can be adjusted at a level such that said upper body is free to vertically reciprocate relative to said channel means between said lower and top limit positions.

Preferably, guide means are carried by said frame for guiding said drill bit. Advantageously, said drill bit guide means includes a support, anchored at one end to a lower section of said main frame and downwardly outwardly depending therefrom, and having a horizontal bottom leg which is centrally bored for free engagement by said drill bit.

It would be desirable that there be three such hammers, each individually mounted to said main frame in transversely spaced apart fashion and individually controlled but concurrently operable.

Spring means are preferably fixed to said frame and against which will abut said drill upper body at said top limit position, and destined to dampen the upward stroke of said hammer. Said frame may then profitably include a main vertical panel, a top horizontal flange anchored to said vertical panel; said spring means being embodied in a metallic leaf spring, anchored at one end to the underside of said top flange and having a free downwardly outwardly inclined leg in vertical register with said upper body.

Advantageously, said holding means for the frame includes an anchor base, a pair of power-operated arms mounted at one end to said anchor base for relative movement thereabout, and a mount to interconnect said arms to said frame at its end opposite said one end thereof. Preferably then, said anchor base is an automotive vehicle operated by a worker installed in the cabin of the vehicle. It would be desirable that indicator means be provided to enable said worker to readily ascertain at what specific position is the hammer along its said channel members between its top and bottom limit positions. Preferably, said hammer upper body is elongated with said drill bit being coaxial with said upper body and further including a pair of handle bars fixed to and tranversely protruding from opposite sides of the top of said upper body; wherein said indicator means include an elongated stem and a ring member integral with one end of said stem and engaged by one handle bar sidewisely of said upper body, said stem extending upwardly and being visible to said worker along the whole travel of said hammer between its top and bottom limit positions.

Profitably, said frame includes a main vertical panel, and a top horizontal flange anchored to said vertical panel; and wherein said channel means include two pairs of tubular members downwardly depending from said frame top flange, each pair slidably engaging opposite sides of one handle bar, and wherein said support means includes a transverse removable rod interconnecting the lower end of each pair of tubular members.

Since said upper body carries a laterally protruding nipple for feeding compressed air thereto, it is prefered to further provide a third pair of tubular members which downwardly depend from said frame top flange at a lower level than said transverse rods and engaging opposite sides of said nipple.

Preferably, said rods and tubular members are each covered by a sleeve made of an impact absorbing elastomeric material.

Advantageously, said arms are connected to said anchor base by first pivot means for pivotal movement about a horizontal axis, and further including first hydraulic ram means for rotating said arms about said first pivot and thus translating said hammer thereabout. Said arms are preferably further connected to said mount by second pivot means for pivotal movement about a horizontal axis and further including second hydraulic ram means for rotating said mount about said second pivot means and thus tranlating said hammer thereabout.

BRIEF DESCRIPTION OF THE DRAWINGS

FIG. 2 is an enlarged front elevational view of the hammer assembly, taken along lines 2—2 of FIG. 1;

FIG. 3 is a cross-sectional view taken along lines 3—3 of FIG. 2;

FIGS. 4 and 4*a*, on the third sheet of drawings, are enlarged vertical sectional elevational views taken along line 4—4 of FIG. 2, suggesting how the hammer assembly operates; and FIG. 5, on the second sheet of drawings, is a partially cross-sectional view taken along broken lines 5—5 of FIG. 4*a*.

DETAILED DESCRIPTION OF THE INVENTION

Figure 1:
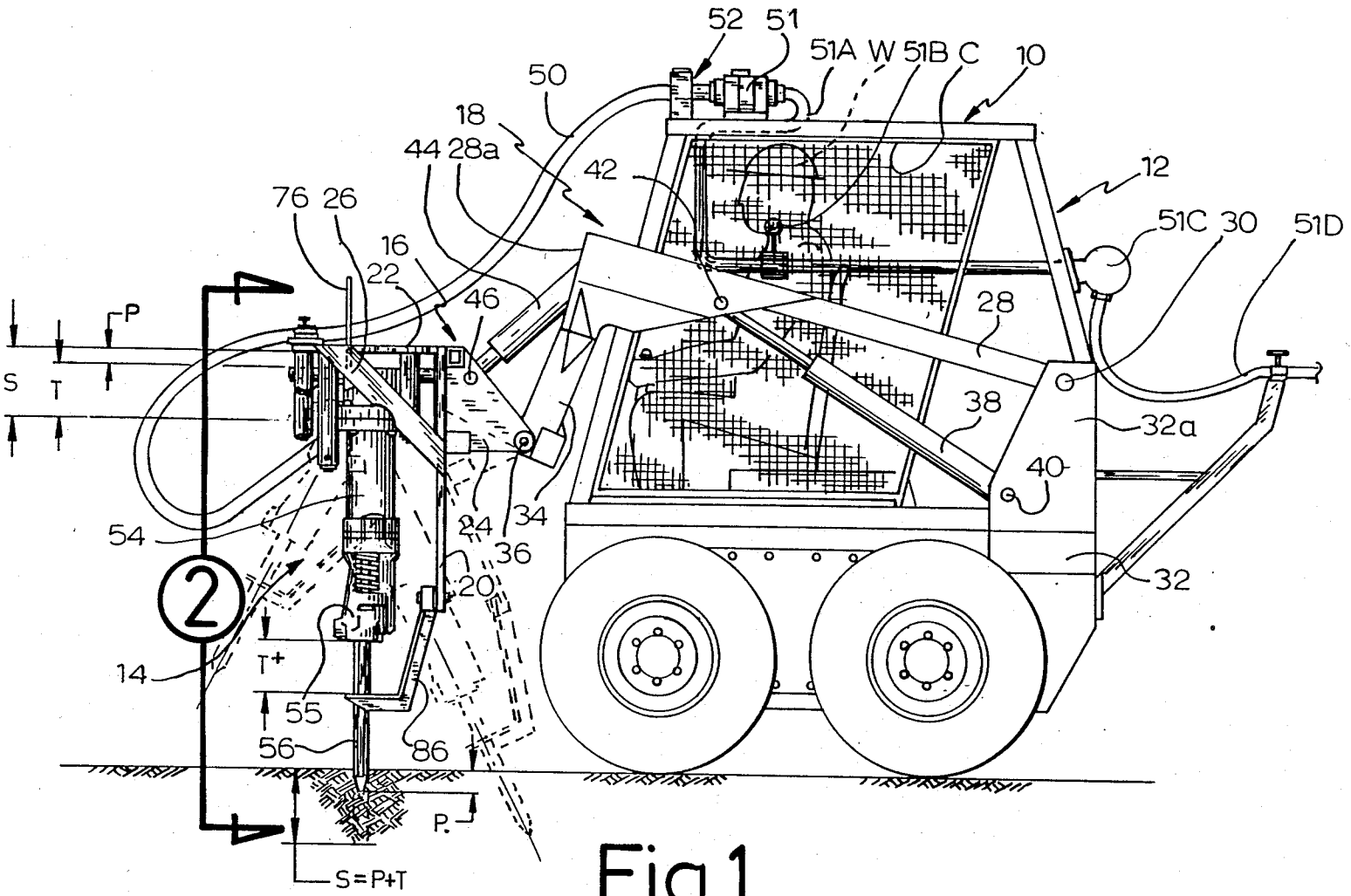
FIG. 1 is a side elevational view of a tractor and a hammer assembly carried in front thereof in accordance with the invention.

Vehicule 10 includes an automotive tractor 12, pneumatic hammer or breaker units 14 (three being shown), a mount 16 for units 14, and operating members 18 for enabling a worker W to control the relative position of mount 16 from the cabin C of the tractor 12. Mount 16 defines a large rectangular panel 20, a top flange plate 22 fixedly transversely secured to the top edge of said panel 20 and stay plates 24 extending on the opposite side of flange 22 at right angles to both flange 22 and panel 20. Reinforcing cross-struts 26 also link flange 22 to upper panel 20 in their right-angle relationship. Operating members 18 include a U-shape frame 28, pivoted at its two side legs ends 30 to a rear upper section **32*a* of the chassis 32 of the tractor 12, and also pivoted to the mount stay plates 24 by two arms 34 transversely projecting from the base leg 28*a* and engaged at its outer end by a pivotal rod 36 rotatably joining the two opposite free corners 24*a* of the triangular stay plates 24. Pivotal movement of frame 28 about horizontal axis 30 is controlled by a pair of hydraulic rams 38 (one on each side of cabin C), pivoted at one end 40 to the section 32*a* of chassis 32 below axis 30, and at the other end 42 to frame 28 proximate base leg 28*a* thereof. Pivotal movement of mount 16 about horizontal axis 36 is controlled by another pair of rams 44, pivoted at one end to base leg 28*a* and at the other end 46 to an upper section of stay plates 24 proximate upper panel 20. Hence, mount 16 together with breaker units 14 supported thereby may both rotate about axis 36, as suggested by the dotted lines at the left side of FIG. 1, and also translate about axis 30**, from an inoperative position which may be well above ground down to its operative position at the front of the tractor.

Each pneumatic hammer or breaker unit 14 is of the conventional manually operated type. Mount 16 can support a number of breakers 14, three being shown in the drawings but one, two, four or more breakers could also be supported by mount 16. Each breaker 14 is connected by its nipple **92*a* (see FIG. 3), detailed later, to a pressurized air source, not shown, via a flexible rubber hose 50, connector 51, line 51*a*, fitted with a control lever value 51*b*, manifold 51*c* and common line 51*d*. Hose 50 may be fixed by brackets 52 on the top of the tractor cabin C. Each breaker 14 is supported over ground at the level of the horizontal flange 22 of mount 16, in vertical position and spacedly from the other breakers 14. Each breaker 14 includes an upper body 54, a lower reciprocatable head 55 and a drill bit 56 defining a bottom sharp tip 56*a* and removably fixed to head 55. Head 55 is driven in reciprocating motion by a pressure actuated piston (not shown) inside the upper body 54. Biasing coil springs 60 (FIG. 4), guided by rods 58, dampen the upward return stroke of head 55**.

A pair of handle bars 62 (FIG. 3) transversely protrude from and are fixed to opposite sides of the top of the upper body 54; handle bars 62 are aligned transversely of the upper body.

Two pairs of cylindrical guide tubes **64*a*, 64*b* (FIG. 3) and 66*a*, 66*b* (FIG. 5) downwardly depend from the mount top flange 22, being fixed thereto by welding P or the like, and on opposite sides of breakers 14 relative to an axis orthogonal to the mount upper panel 20. The transversely spaced tubes 64*a*, 64*b* are interconnected attheir bottom end by a short horizontal removable rod 68, and similarly, the bottom ends of tubes 66*a*, 66*b* are interconnected by a short removable rod 70. The transverse handle bars 62 of a given breaker 14 engage through both vertical channels 72 defined between tubes 64*a*–64*b* and 66*a*–66*b* whereby the maximum vertical travel of bars 62 therethrough is limited by the lower rods 68 and 70 and by a leaf spring 82 fixed to and dependant from the upper flange 22 (FIG. 5**).

It can now be understood from FIGS. **4–4*a* that, in operation, the worker W can adjust the level of mount 16 so that the handle bars 62 remain free floating within guiding channels 72: the reciprocating drill bits 56 will thus break the concrete A or the like solely under the bias of the weight of the breaker 14 per se, i.e. that no downward pressure will be exerted by the frame 28 to push the drill bits against the ground. As the drill bits 56 cut deeper into the concrete (FIG. 4*a*), the whole breakers 14 will sink since transverse handle bars 62 will slide down between the tubes 64*a*–64*b* and 66*a*–66*b* along channels 72**.

The exact relative height of mount 16, and thus of top limit spring 82 and bottom limit rods 68–70, is adjusted by the worker W in cabin C by control of hydraulic rams 38 (FIG. 1); and the exact angular orientation of the drill bit 56 relative to the ground is also adjusted from cabin C by control of rams 44. At the initial phase of concrete breaking, rams 38 should be actuated to bring handle bars 62 proximate to but spaced from flange 22, when drill bit 56 rests freely on the surface of the ground as shown in FIG. 4: indeed, it is necessary to leave a top clearance for bars 62 since when concrete breaking begins, the reciprocating travel of breaker head 55 will induce some reciprocating travel of the breaker upper body 54 as well, and it would not be desirable that the top end **54*a* of the breaker body strikes the flange 22** in operation, accordingly with the objects of the invention.

Advantageously, rods 68, 70 are each surrounded by an elastomeric sleeve 74 (FIG. 5), as are tubes **66*a*, 66*b* with elastomeric sleeve 75, these sleeves being destined to cushion the impact of transverse handle bar 62** thereon at its lower limit position during reciprocating movement of the breaker.

Also, it is desirable that some means be provided to enable the operator W to readily ascertain from his cabin C the relative position of bar 62 between its two limit positions 82 and **64*a*–*b*, 66*a*–*b*. Such means may consist of a stem 76, having a ring 78 (FIG. 4) welded at one end. Ring 78 slidingly engages a bar 62, while the free upper end of stem 76 extends through a bore 80 made in flange 22. Stem 76 should be long enough wherein at least its top section projects upwardly from bore 80 even when bars 62 in their lower limit position, i.e. when abutting against rods 68, 70 (FIG. 2**).

Means should be further provided to dampen the upward counter-stroke of the breaker 14 should breaker body come too close to flange 22. Such means are embodied in a metallic leaf spring or strip 82 anchored at an elbowed end section **82*a* to flange 22 by bolts 84**

(FIG. 5). The upper metallic strip body 82 is downwardly inclined, with a curved slightly upturned free end 82*b*, this free end 82*b* being in coaxial register with the upper breaker body 54 of a given unit 14, there being as many spring strips 82 as there are breaker units 14. It is well illustrated in the sequence of FIGS. 4–4*a* how the metallic leaf spring 82 is compressed when taken in sandwich between the top end 54*a* of breaker body 54 and flange 22.

Guide means are also provided for guiding the reciprocating displacement of drill bit 56 of each breaker unit 14 along its maximum travel "s" (see the right side of FIG. 2). Such guide means includes a stabilizing support 86 forming an elongated narrow plate, screwed at one end 86*a* to the bottom edge of the mount upper panel 20 by bolts 88, and defining a main body outwardly downwardly inclined relative to the plane of panel 20, and a bottom transverse horizontal leg 90 having a central bore 90*a* for free engagement by the drill bit 56. Drill bit 56 will slide through bore 90*a* during level adjustment of mount 16 and during reciprocating movement of the breaker unit 14.

It can be understood that, for uppertenance purposes, a spent drill bit 56 having sustained wear can be replaced easily, by, if necessary, removing fork 86 from panel 20 through simply unscrewing bolts 88. [Typically, a drill bit 56 usually lasts for not more than ten hours of hard work after which it must be sharpened.]

Each breaker unit 14 conventionally further includes a large collar 92, square at its outer periphery and integral with or fixedly engaging e.g. by welding the upper section of the breaker upper body 54. Downwardly inclined nipple 92*a* is fixed to collar 92. Two additional cylindrical tubes 94*a*, 94*b* downwardly depend from flange 22, fixed thereto e.g. by welding W, between tubes 64*a*, 66*a* and 64*b*, 66*b* and longer than the latter, and in respective transverse register therewith. Tubes 94*a—b* are preferably surrounded by an elastomeric sleeve 95. As clearly shown in FIG. 3, tubes 66*a*, 66*b*, 94*a*, 94*b* constitute four rail members engaging the four corners of the cross-sectionally square collar 92, for guiding the displacement of breaker body 54 along an axis exactly orthogonal to flange 22, i.e. vertically when a breaker unit 14 is vertical. Tubes 94*a*, 94*b* also engage opposite sides of nipple 92*a* to prevent rotation of unit 14 and must be longer than tubes 64*a*, 64*b*, 66*a*, 66*b*, as shown in the drawings, since collar 92 is downwardly spaced from transverse bar 62. Ring 78 is freely mounted around bar 62 between tubes 94*a* and upper cylindrical body 54, since its thickness is smaller than that of collar 92.

Body 54 is guided against lateral displacement by tubes 94*a*, 94*b* abutting collar 92 and by a pad 96 (FIG. 4) fixed to panel 20 and abutting the proximate end of one handle bar 62. It is easy to remove bolts 68, 70 for the installation and removal of breaker units 14 within and from mount 16.

Hence, in operation mount 16 serves only as a guide for each breaker unit 14: it defines the relative orientation of the unit 14, and the top and bottom limit positions thereof. But within its operative range, the breaker unit, hammers the ground solely under the bias of its own weight. The arms 34 of the tractor 12 clearly must not push down the breaker units against the ground in accordance with the invention.

It can be readily understood that the precision of work of the hammers enables a single operator to monitor all hammers breaking of a specific layer of concrete slab, without affecting the underlying layer.

I claim:

1. A hammer apparatus for breaking a layer of concrete slab or the like hard material, comprising a rigid frame, vertically adjustable holding means to hold said frame at an adjustable level above said material, at least one pneumatic hammer comprising an elongated upper body with two top transverse handle bars rigid with and extending from opposite sides of said body, a lower reciprocating head, and a drill bit releasably fixed to said drill head, support means fixedly carried by said frame and directly engageable with the underside of said handle bars to hangingly support said upper body at a lower limit position of said upper body relative to said frame, first guide means carried by said frame above said support means and directly engageable with the opposite sides of said handle bars to guide vertical displacement of said upper body between said lower limit position and a top limit position, while preventing rotation of said upper body about its longitudinal axis, second guide means carried by said frame below said support means and guiding the vertical displacement of said drill bit, and indicator means visible to a worker controlling said holding means to enable said worker to readily ascertain at what specific position is the body along said first guide means between its top and lower limit positions, whereby; during layer breaking with said hammer upright and said bit resting on said material, the level of said frame can be adjusted such that said upper body is free to vertically reciprocate relative to said first guide means between said lower and top limit positions.

2. A hammer apparatus as defined in claim 1, wherein said second guide means includes a bracket, anchored at one end to a lower section of said frame and downwardly depending therefrom, and having a horizontal bottom leg which is centrally bored for free engagement by said drill bit.

3. A hammer apparatus as defined in claim 1, wherein there are three such hammers, each individually mounted to said frame in transversely spaced apart fashion and individually controlled but concurrently operable.

4. A hammer apparatus as defined in claim 1, further including spring means fixed to said frame and against which will abut said upper body if it reaches said top limit position and adapted to absorb the shock of the upward stroke of said upper body when substantially reaching said top limit position.

5. A hammer apparatus as defined in claim 4, wherein said frame includes a main vertical panel, a top horizontal flange anchored to said vertical panel; said spring means being a metallic leaf spring, anchored at one end to the underside of said top flange and having a free downwardly outwardly inclined leg in vertical register with said upper body.

6. A hammer apparatus as defined in claim 1, wherein said holding means for the frame includes an anchor base, power-operated arms mounted at one end to said anchor base for relative movement thereabout, and a mount to interconnect said arms to said frame at its end opposite said one end thereof.

7. A hammer apparatus as defined in claim 6, wherein said anchor base is an automotive vehicle operated by a worker installed in the cabin of the vehicle.

8. A hammer apparatus as defined in claim 1, wherein said indicator means includes an elongated stem and a ring member integral to one end of said stem and engaged by one handle bar sidewisely of said upper body, said stem extending upwardly and being visible to said worker along the whole travel of said upper body between its lower and top limit positions.

9. A hammer apparatus as defined in claim 1, wherein said frame includes a vertical panel, and a top horizontal flange anchored to said vertical panel; and wherein said first guide means include two pairs of tubular members downwardly depending from said frame top flange, each pair slidably engaging opposite sides of one handle bar, and wherein said support means includes a transverse removable rod interconnecting the lower ends of the tubular members of each pair.

10. A hammer apparatus as defined in claim 9, wherein said upper body carries a laterally protruding nipple for feeding compresses air thereto, and further including a third pair of tubular members which depend from said frame top flange down to a lower level than said transverse rods and engaging opposite sides of said nipple.

11. A hammer apparatus as defined in claim 10, wherein said rods and tubular members are each covered by a sleeve made of an impact absorbing elastomeric material.

12. An apparatus for mounting a hand-held pneumatic hammer for breaking a layer of concrete slab or the like hard material, said hammer of the type comprising an elongated upper body, a lower reciprocating head and a drill bit releasably fixed to said drill head, said apparatus comprising a rigid frame having attachment means to attach said frame to a power-operated, worker-controlled, vertically-adjustable holding means to hold said frame at an adjustable level above said surface, support means fixedly carried by said frame and directly engageable with an underface of said upper body to support said upper body at a lower limit position relative to said frame, first guide means carried by said frame above said support means and directly engageable with opposite sides of said body above said support means to guide vertical displacement of said upper body between said lower limit position and a top limit position, while preventing rotation of said body about its longitudinal axis, second guide means carried by said frame below said support means for guiding vertical displacement of said drill bit and indicator means visible to said worker to enable the latter to readily ascertain at what specific position is the upper body along said first guide means between its top and bottom limit positions, whereby during the breaking work with said drill bit abutting on a hard material, said holding means can be adjusted at a level such that said upper body is free to vertically reciprocate relative to said first guide means between said lower and top limit positions.

13. An apparatus as defined in claim 12, wherein said pneumatic hammer is of the type in which said upper body is provided with two top transverse handle bars rigidly secured to and extending from opposite sides of said upper body, said first guide means shaped to directly engage opposite sides of said handle bars.

14. An apparatus as defined in claim 13, wherein said first guide means include two pairs of elongated members carried upright by said rigid frame, each pair for one handle bar, the members of each pair spaced apart a distance to directly engage opposite sides of one handle bar, said support means including, for each pair, a transverse member attached to the lower ends of the members and detachable to permit removal of said handle bar from between said members.

15. An apparatus as defined in claim 14, further including layers of impact-absorbing elastomeric material covering said upright members and said transverse members.

* * * * *